United States Patent [19]

del Castillo

[11] Patent Number: 4,841,887

[45] Date of Patent: Jun. 27, 1989

[54] SEMI-AUTOMATIC SEWING STATION

[75] Inventor: Fernando del Castillo, Brownsville, Tex.

[73] Assignee: Ideal Equipment Co., Ltd., Montreal, Canada

[21] Appl. No.: 250,253

[22] Filed: Sep. 27, 1988

[51] Int. Cl.[4] ..... D05B 21/00; D05B 33/00

[52] U.S. Cl. ..... 112/121.12; 112/121.29

[58] Field of Search ..... 112/121.12, 121.11, 112/121.15, 121.29, 102, 113, 308, 309, 104

[56] References Cited

U.S. PATENT DOCUMENTS

| | | | |
|---|---|---|---|
| 3,170,423 | 2/1965 | Henebry | 112/121.12 |
| 3,358,626 | 12/1967 | Bryan | 112/121.12 |
| 3,448,705 | 6/1969 | Scherr et al. | 112/102 X |
| 3,474,747 | 10/1969 | Noiles | 112/121.12 |
| 3,543,737 | 12/1970 | Maschmann | 112/102 |
| 3,769,924 | 11/1973 | Rogers et al. | 112/121.12 X |

*Primary Examiner*—H. Hampton Hunter
*Attorney, Agent, or Firm*—G. Turner Moller

[57] ABSTRACT

A convertible semiautomated sewing station runs and top stitches cuffs, collars, shirt flaps or decorative pieces. Instead of gripping the sewn fabric blanks as in the prior art, a presser arm pushes the fabric blanks against a work table and slides the blanks from a loading guide to a sewing head and then to a transfer station. A pick up mechanism moves the sewn blanks from the transfer station to a station where the sewn blanks are accumulated. Small apparel manufactures can convert the machine from producing cuffs to producing collars, pocket flaps or decorative pieces, or vice versa, in only a few minutes. The cycle time of the station is less than the prior art because the presser arm does not have to move the sewn blanks all the way to the accumulator station.

15 Claims, 3 Drawing Sheets

SEMI-AUTOMATIC SEWING STATION

This invention relates to a work station where sewing operations are conducted on shirt cuffs, collars, pockets and/or pocket flaps.

The manufacture of apparel has recently changed from a hand manipulated, machine sewing operation to a series of semi automated processes. This change has reduced the labor content of apparel so its manufacture has returned, to a significant degree, to the better developed countries from underdeveloped countries where labor costs are quite low.

Three of the processes which have been semi automated are the manufacture of shirt cuffs, shirt collars and western shirt flaps from cut blanks of material into a subassembly which is ready to be sewn onto panels of fabric which will ultimately become a shirt. There are two distinct operations: (1) a running operation in which fabric blanks are sewn together along a path near three sides; and (2) after the run blanks are inverted or turned inside out, a top stitching operation in which a second series of stitches are sewn near the same three sides of the blanks.

Cuff, collar and shirt flap running and top stitching machines historically are quite similar because the operations are quite similar. Exemplary state of the art cuff and collar machines are known as Ideal Models 6015 and 6112. These machines include a loading guide having a recess of the same shape as the cuff or collar fabric blanks. In a running operation, the station operator places three pieces of material into the guide, two identical pieces that will become the front and back of the cuff or collar and a backing piece that will become an interior layer. Oddly, the backing piece is placed either on top or on bottom of the three layers. The operator starts the machine and a grasping mechanism having two pairs of grasping fingers or plates approaches the guide and grasps the three pieces as a unit. The loading guide is elevated to allow the fingers and material to exit from the guide, and the grasping mechanism is then moved to a location under a sewing head. At the sewing location, the grasping mechanism moves the three pieces of material in a path corresponding to the desired stitch path while the sewing head is stitching the material. At the end of the sewing operation, the thread is cut and the grasping mechanism moves the sewn blank to an accumulator.

The top stitching operation is very similar, the major difference being that the run blank is inverted and placed as a unit in the loading guide rather than handling three separate pieces of material. Because of the difference in the shape of cuffs and collars, collar machines differ from cuff machines in the shape of the loading guide and in the construction of the grasping mechanism. Cuff and collar machines are very similar in manufacture and contain many substantially identical parts. Theoretically they may be converted from one to the other, but the conversion is not lightly done because it takes a skilled mechanic several days to remove and replace the grasping mechanism and loading guides. It is just as difficult to convert cuff or collar running machines into top stitching machines because the both the grasping mechanism and the loading guide must be replaced.

A manufacturer typically must buy at least two cuff machines and at least two collar machines. Large manufacturers have many of each of the various type of machines. Small manufacturers cannot justify any equipment because they do not have sufficient volume to warrant separate machines.

Another operation done in the prior art is a decorative stitch performed on some apparel part, such as a pocket, which ultimately incorporated into the garment. As will be more fully apparent hereinafter, this type operation can also be done with the machine of this invention.

As used herein, the term "cuff/collar" is an adjective that means cuff, collar or shirt flap or a noun that means cuff, collar or shirt flap. In one aspect, this invention comprises a machine that can be easily converted between cuff, collar or shirt flap operations. This is accomplished by changing the design and operation of the grasping mechanism. The analogous mechanism of this invention comprises a presser arm that is the shape of the cuff/collar being sewn. The presser arm is mounted on a movable member of an x-y positioner and, at the start of an operating cycle, moves over the loading guide and then moves downwardly to press the fabric onto the smooth upper surface of a work table. Next, the loading guide is elevated to an out-of-the-way position so the presser arm and fabric can move horizontally along the work table to slide the fabric blanks on the work table. The x-y positioner then moves the presser arm and fabric to a location under the sewing head. At the appropriate time, the head begins to sew while the x-y positioner moves the fabric in the desired path to produce the desired stitch arrangement. For cuffs, collars and shirt flaps, sewing is done on three sides of the periphery of the fabric blanks. For decorative stitching on the inside of the fabric blank, the presser arm provides an opening, spaced from the periphery of the arm, so the decorative stitch can be accomplished on the interior of the fabric blank.

When sewing is done, the x-y positioner moves the sewn blank to an intermediate position on a side of the sewing head opposite from the loading guide. The presser arm is then moved upwardly off the fabric blanks, leaving the sewn blanks on the work table. A separate mechanism then moves the sewn blanks into an accumulator while the x-y positioner moves back toward the loading guide.

To change from a cuff running to a cuff top stitching operation, all that need be done is to replace the presser arm with a slightly differently shaped arm and reset the computer control to modify the stitching. To change between cuff/collar machines, the presser arm and the loading guide both need to be removed and replaced. This operation takes only a few minutes.

Thus, the machine of this invention has substantial advantages for the small apparel manufacturer because he can now justify a machine to do cuffs, collars, shirt flaps and interior decorative work because the machine can be operated substantially continuously merely by converting it from one operation to the next. This invention also has substantial advantages to the large apparel manufacturer for several reasons: (1) it has a shorter cycle time and thus higher productivity than the prior art; (2) it is simpler and has fewer parts and accordingly requires less maintenance and has less down time; and (3) even a large manufacturer appreciates the ability to convert a machine from one function to another to smooth out production runs or temporarily change functions when another machine is down.

It is accordingly an object of this invention to provide an improved machine for sewing cuffs, collars, shirt flaps and decorative pieces.

Another object of this invention is to provide a machine which can be converted from sewing cuffs to one sewing collars, shirt flaps or decorative pieces and vice versa.

A further object of this invention is to provide an improved machine for sewing cuffs, collars, shirt flaps or decorative pieces which is simpler, has fewer parts, requires less maintenance, has less down time and has higher productivity.

Other objects and advantages of this invention will become more fully apparent as this description proceeds, reference being made to the accompanying drawings and appended claims.

IN THE DRAWINGS

Figure 1:
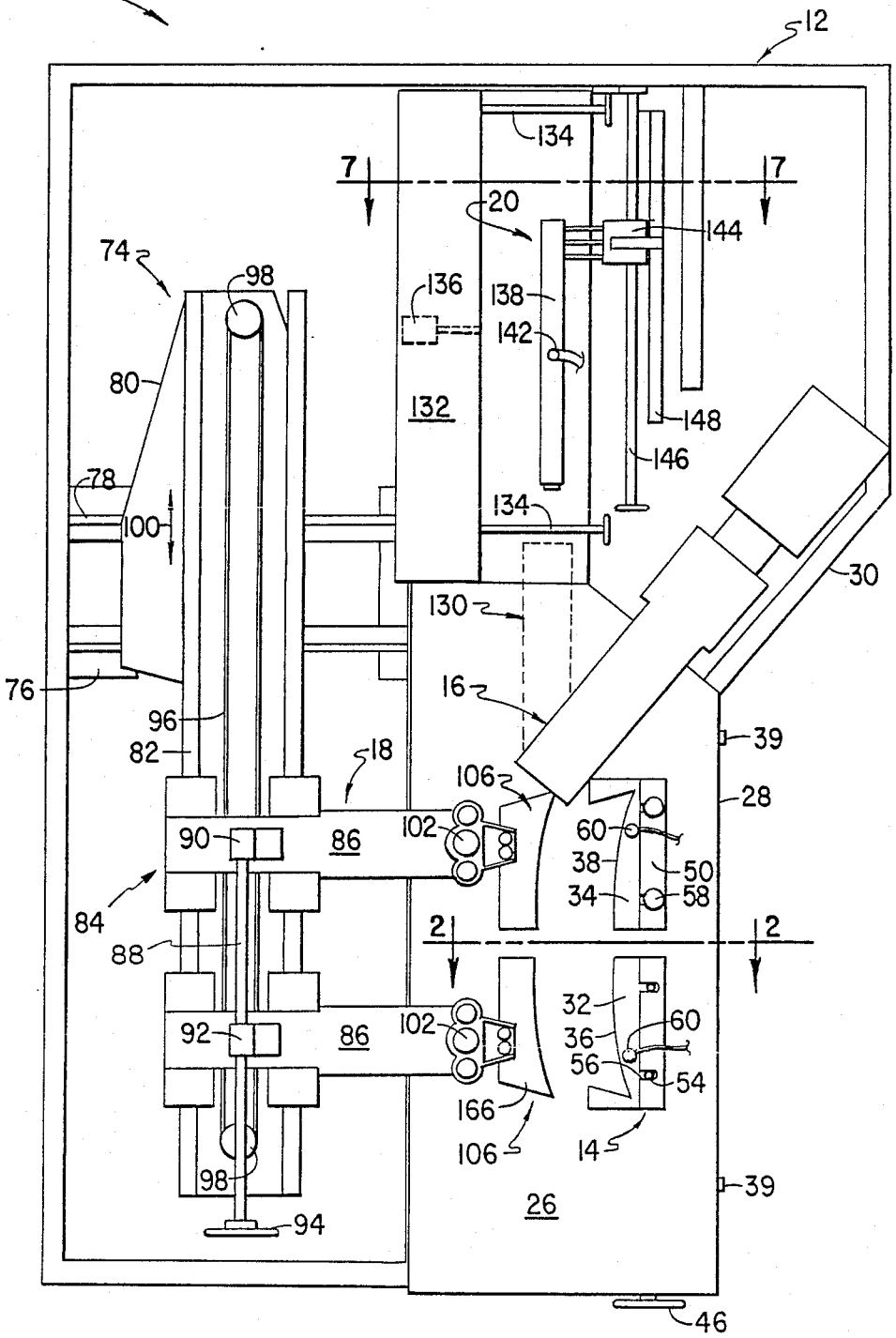
FIG. 1 is a top plan view of a machine of this invention configured to conduct a running operation on collars.

Referring to FIGS. 1–4, a machine 10 of this invention comprises, as major components, a work table 12, a loading guide 14 for receiving fabric blanks therein, a sewing head 16, means 18 for sliding the fabric blanks from the loading guide 14 toward the sewing head 16 and then to an intermediate of transfer location and a transfer mechanism 20 for moving the sewn blanks from the intermediate location to an accumulator 22.

The work table 12 includes suitable legs 24 and a smooth planar table section 26 which is stainless steel or the like so it remains smooth, for a substantial period. As shown in FIG. 1, the work table 12 is rectangular except for a recess 28 having an inclined edge 30. The recess 28 accordingly provides a position where an operator stands or sits during use of the machine 10.

Figure 2:
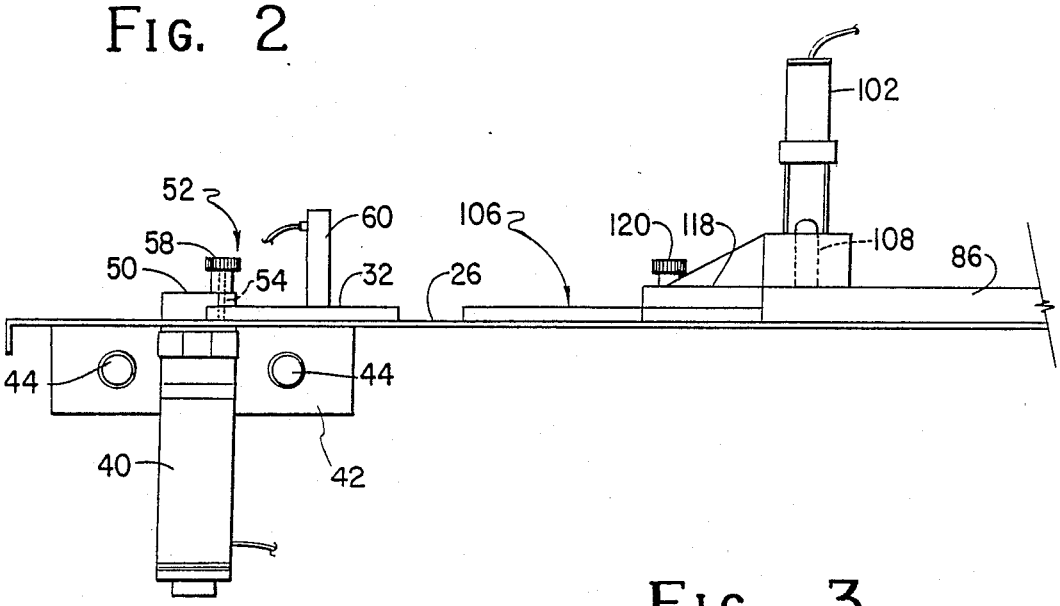
FIG. 2 is an enlarged vertical cross-sectional view of the machine of FIG. 1, taken substantially along line 2—2 thereof, as viewed in the direction indicated by the arrows.
Figure 3:
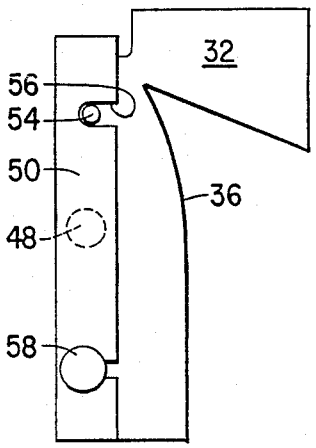
FIG. 3 is an enlarged top view of the presser arm and loading guide of FIG. 2.
Figure 3:
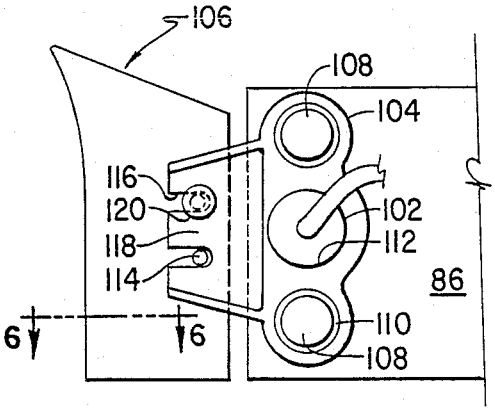

As shown in FIGS. 1–3, the loading guide 14 is substantially the same as the loading guides on the Ideal Model 6112 Collar machine. The loading guide 14 includes a pair of planar mirror image- guide sections 32, 34 providing collar shaped recess halves 36, 38. The loading guide 14 includes a pair of air cylinders 40 mounted on brackets 42 under the table 26. Preferably, the guide section 34 is stationary while the bracket 42 of the guide section 32 is mounted on a pair of rails 44 for linear adjustable movement toward and away from the guide section 34 to allow various collar blanks to be accommodated by the loading guide 14. This adjustment is carried out in any suitable fashion, as by rotation of a handle 46 operating a mechanism (not shown) under the table section 26 or a motor controlled device (not shown).

The cylinder 40 includes an output member 48 extending through an opening in the table section 26 to connect with a central section of the bar 50 on top of the table section 26. The cylinder 40 thus provides for convenient vertical movement to allow the loading guide 14 to be moved out of the way of the sliding means 18. Although the bar 50 is shown as mounted for linear movement, it is evident that any suitable motion, such as pivoting, is satisfactory so long as the bar is moved out of the way of the sliding means 18. The bar 50 includes a pair of clamping mechanisms 52 for releasably connecting the guide sections 32, 34 to the bars 50. To this end, the mechanisms include a threaded stud 54 integral with the guide sections 32, 34 extending upwardly through a slot 56 in the bar 50. A hand nut 58 threads onto the stud 54 and clamps the guide section 34 to the bar 50.

A pair of small air cylinders 60 include an output member (not shown) spaced over fabric blanks placed in the recesses 36, 38. In order to start operation of the machine 10, the operator depresses a pair of spaced switches 39 which actuate the air cylinders 60 to press against the fabric blanks. This keeps the blanks in place and prevents the operators fingers from getting mashed by the machine 10. Those skilled in the art will recognize the loading guide 14 as representative of the prior art, such as found in Ideal Model 6112 Collar Run Stitcher. To change the loading guide 14, the nuts 58 are unthreaded to release the guide sections 32, 34 from the bar 50. The guide sections 32, 34 are removed by sliding them toward the sliding means 18 when it is retracted.

Figure 4:
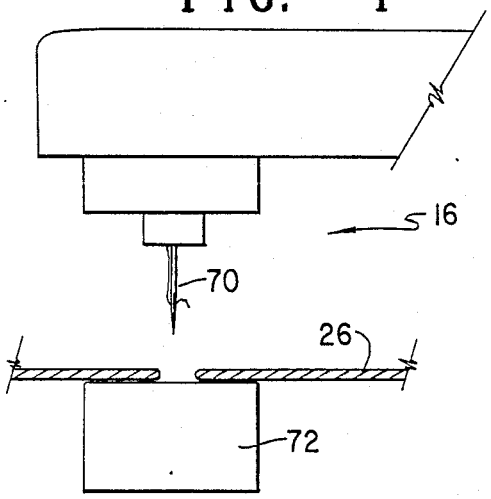
FIG. 4 is a stylized view of the sewing head.

As shown in FIGS. 1 and 4, the sewing head 16 is of any suitable type. As is conventional, the sewing head 16 includes a reciprocating sewing needle 70 above the table 12 and a hook mechanism 72 below the table 12. The sewing head 16 is positioned at an angle relative to the loading guide 14, parallel to the edge 30, so sewing on the fabric blanks being handled by the sliding means 18 can begin almost as soon as the blanks exit from the loading guide 14. By canting the sewing head 16, the operator standing in the recess is not interfered with by the motor end of the sewing head 16.

The sliding means 18 comprises a conventional x-y positioner 74 including a carriage support 76 rigid with the work table 12 and including rails 78 and a y-carriage 80 mounted on the rails 78 for movement parallel thereto. Means (not shown) are provided for moving the y-carriage on the rails 78. The carriage 80 includes a pair of rails 82 on which is rollably mounted an x-carriage 84 including a pair of substantially identical members 86. The members 86 are adjustable toward and away from each other in any suitable fashion, as by a threaded shaft 88, bearing assembly 90 and threaded block 92 or motor controlled device (not shown). A hand wheel 94 rotates the shaft 88 and moves the members 86 toward or away from each other. A timing belt 96 is wound about a pair of sprockets 98 and includes a connection (not shown) to one of the movable members 86. Driving the sprockets 98 moves the x-carriage 84 in a direction parallel to the arrow 100 while movement of the y-carriage 80 causes movement perpendicular to the arrow 100. The x-y positioner 74 is more-or-less conventional and similar positioners may be seen on Ideal Model 6862 Pocket Setter.

As shown best in FIGS. 1–3, an air cylinder 102 and casting 104 are mounted adjacent the end of each of the movable members 86 for raising and lowering a presser arm 106 relative to the member 86 and table section 26. The movable member 86 includes a pair of vertical guide rods 108 extending through bushings 110 pressed or otherwise secured to the casting 104. The air cylinder 102 is fixed in a passage 112 and includes an extensible output member attached to the member 86 in any suitable fashion. Thus, actuation of the cylinder 102 causes the casting 104 to rise on the guide rods 108.

The presser arm 106 is of collar shape and sized to fit in the recess 36 of the guide section 32. The presser arm 106 includes a pair of vertical threaded studs 114 received in slots 116 provided in the forward end 118 of the casting 104. A hand nut 120 threads onto the end of the studs 114 and clamps the presser arm 106 to the casting 104. When the casting 104 moves downwardly on the guide rods 108, the presser arm 106 pushes the fabric blanks into engagement with the table section 26.

Figure 5:
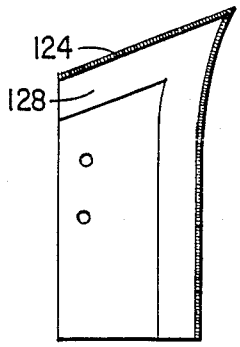
FIG. 5 is a bottom view of a presser arm of this invention.
Figure 6:
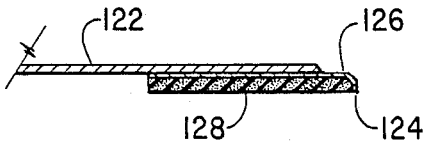
FIG. 6 is an enlarged cross-sectional view of the presser arm of FIGS. 3 and 5, taken substantially along line 6—6 of FIG. 3 as viewed in the direction indicated by the arrows.

As shown in FIGS. 5 and 6, the presser arm 106 includes a generally planar plate 122 having a serrated vertical edge 124 provided by a metallic strip 126 secured to the underside of the plate 122. A foam rubber strip 128 extends around the plate 122 covering the strip 126 and is on the same order of thickness as the vertical serrated edge 124. The bottom of the presser arm 106 is accordingly very rougl compared to the smooth table section 26. Thus, when the presser arm 106 is pushed against the fabric blanks and then moved horizontally in response to movement of the x-y positioner 74, the fabric blanks slide on the table section 26 rather than move relative to the presser arm 106.

Operation of the machine 10 should now be apparent. In a running operation, the operator places, the three fabric collar shaped blanks on the loading- guide 14 and presses the start switches 39. The air cylinders 60 press against the fabric blanks to temporarily hold them in place. The presser arms 106 are at an elevated position off the table 12. The x-y positioner 74 moves the members 86 to the position shown in FIG. 1 and then moves the members 86 toward and over the top of the guide sections 32, 34. When the presser arms 106 are aligned with the recesses 36, 38, the cylinders 102 move the arms 106 down into engagement with the fabric blanks in the guide sections 32, 34 thereby pushing and captivating the fabric blanks against the table section 26. The air cylinders 60 then retract to free the fabric blanks for horizontal movement.

Next, the air cylinder 40 raises the guide sections 32, 34 to allow the presser arms 106 to move horizontally away from the loading guide 14. The x-y positioner 74 moves the members 86 away from the loading guide 14 and toward a sewing location between the needle 70 and the hook mechanism 72. Because the table section 26 is smooth and the bottom of the presser arms 106 are rough, the fabric blanks slide easily. When the blanks are positioned, the sewing head 16 starts to sew and the x-y positioner 74 moves the fabric blanks in a predetermined path to achieve the desired stitch path.

When sewing is done, the x-y positioner 74 moves the presser arms 106 to a transfer or intermediate location 130 on a side of the sewing head 16 opposite from the loading guide 14 and thus slides the sewn fabric blanks to the location 130. The air cylinders 102 then raise the presser arms 106 away from the fabric blanks and away from the table section 26. Because the sewn blanks do not stick to the presser arms 106, the sewn blanks remain at the location 130 while the presser arms 106 move back toward the loading guide 14.

Figure 7:
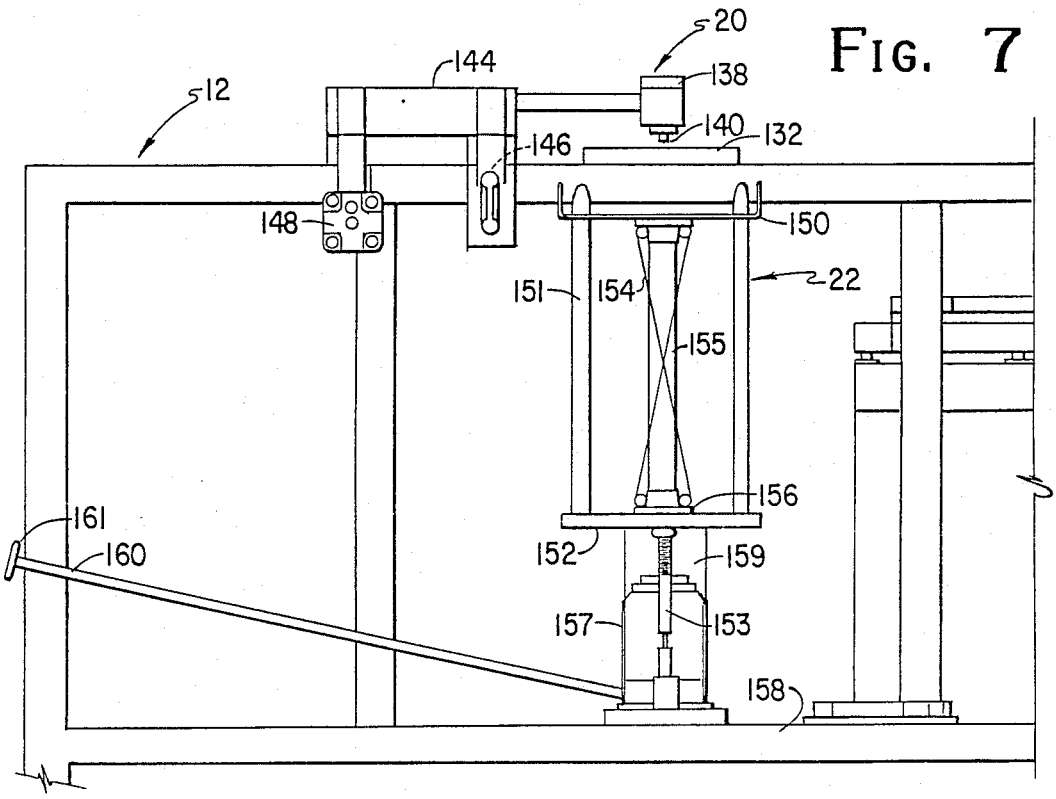
FIG. 7 is a vertical cross-sectional view of the machine of FIG. 1, taken substantially along line 7—7 thereof, as viewed in the direction indicated by the arrows.

While the presser arms 106 are moving between the location 130 and the loading guide 14, the transfer mechanism 20 moves the sewn blanks to the accumulator 22. As shown in FIGS. 1 and 7, the transfer mechanism 20 includes a trap door 132 coplanar with the table section 26. The door 132 moves on a pair of rails 134 from an closed position (FIG. 7) comprising an extension of the table section 26 to an open position (FIG. 1) exposing the accumulator 22. An air cylinder 136 connects to the door 132 and moves it between the open and closed positions.

The transfer mechanism 20 includes a suction bar assembly 138 having a plurality of suction feet 140 on the bottom connected by a hose 142 to a vacuum pump (not shown). The assembly 138 is mounted for movement toward and away from the location 130. To this end, assembly 138 connects to a stacker block 144 having a rear end mounted on a rail 146 and a forward end mounted on the output of an air cylinder 148. The bar assembly 138 is thus capable of moving to the intermediate location, picking up a sewn blank with the vacuum feet 140, moving it to a location over the trap door 132 and then dropping it by releasing the vacuum.

The accumulator 22 is under the trap door 132 and comprises a tray 150 mounted for movement on a plurality of vertical rods 151 extending upwardly from a stationary base 152 supported by a pair of adjustable feet 153. An elongate spring 154 surrounds each of a pair of spaced supports 155 and abut against the bottom of the tray 150 and against a plate 156 immediately above the base 152. The springs 154 thus support the tray 150 from the plate 156 and slowly collapse as the tray 150 accumulates sewn blanks delivered by the transfer mechanism 20. A hydraulic jack 157 is mounted on a beam 158 of the table 12 and includes an output 159 connected to the plate 156. The jack 157 is manipulated by the computer controller to extend as each additional sewn blank is placed in the tray 150. The combined weight of the sewn blanks and the upward movement of the jack output 159 causes the springs 154 to compress during loading of the tray 150. Periodically, the sewn blanks are removed from the tray 150 and the tray 150 is raised by the springs 154. The jack output 159 is lowered to its starting position by rotating the shaft 160 with the hand wheel 161.

Operation of the transfer mechanism 20 should now be apparent. When sewing of the blank is complete, the x-y positioner 74 has moved the fabric blanks to a position where the needle 70 is adjacent an end 166 of the left presser arm 106 and the trap door 132 is in its closed position overlying the accumulator 22. After the thread is cut, the x-y positioner 74 moves the fabric blanks a minimum distance to the right toward the location 130. The blanks are then left behind as the presser arms 106 are elevated. The x-y positioner 74 then moves the presser arms 106 toward the loading guide 14. While the x-y positioner 74 is moving, the bar assembly 138 moves from the position shown in FIG. 1 toward a position overlying the location 130. When the bar assembly 138 overlies the location 130 and thus overlies the sewn fabric blank, a vacuum is applied through the hose 142 in any suitable fashion, as by the opening of a valve. The sewn blank is then picked up against the bar assembly 138 which moves to the right in FIG. 1 to a location overlying the accumulator 22. At the same time, the trap door 132 moves toward its open position so that cutting off the vacuum to the feet 140 causes the sewn blank to fall into the tray 150.

A substantial advantage of the transfer mechanism 20 is that it reduces the distance the presser arms 106 are moved by the x-y positioner 74. The cycle time of the machine of this invention is largely dictated by the distance the members 86 are required to move. By shortening this distance, the cycle time is reduced and productivity increases.

The sequence of operation of the machine of this invention is controlled in a conventional manner by the use of a computer control assembly analogous to those found in Ideal Models 6015 and 6112. In the event a more detailed description of the components of this invention which are in common with those of older Ideal models, reference is made to appropriate maintenance manuals of Ideal Equipment Company, Montreal, Quebec, Canada.

Figure 8:
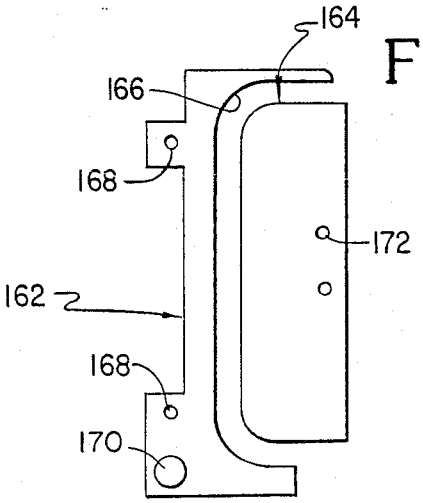
FIG. 8 is a top plan view of a loading guide and presser arm for sewing cuffs.

To convert the machine 10 from a collar operation to a cuff operation, the guide sections 32, 34 and presser arms 106 are removed by unthreading the hand nuts 58, 120 and replacing them with a pair of mirror image guide sections 162 and presser arms 164, one of which is shown in FIG. 8. The guide section 162 provides a cuff shaped recess 166 and is attached to the bar 50 by a pair of threaded studs 168 spaced to pass through the slots 56. An air cylinder 170 presses down on the fabric blanks in the recess 166 in a manner analogous to the air cylinder 60. The guide section 162 will be recognized by those skilled in the art as substantially the same as on an Ideal Model 6015 Cuff Running. The presser arm 164 is cuff shaped and slightly smaller than the recess 166 to fit as shown in FIG. 8. The arm 164 includes a pair of threaded studs 172 to fit in the slots 116 of the casting 104. The computer controlling the sewing head 16 and x-y positioner 74 have to be adjusted to move the presser arms 164 in the desired path and sew two separate cuffs.

Figure 9:
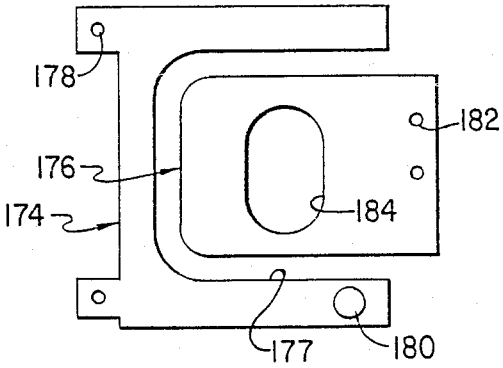
FIG. 9 is a top plan view of a loading guide and presser arm for interior decorative work.

To convert the machine 10 to a pocket decorating operation, the guide sections and presser arms are removed by unthreading the hand nuts 58, 120 and replacing them with a guide section 174 and presser arm 176 as shown in FIG. 9. The guide section 174 provides a pocket or U-shaped recess 177 and is attached to the bar 50 by a pair of threaded studs 178 spaced to pass through the slots 56. An air cylinder 180 presses down on the fabric blanks in the recess 176 in a manner analogous to the air cylinder 60. The presser arm 176 is generally pocket shaped and slightly smaller than the recess 176 to fit therein as shown in FIG. 9. The arm 176 includes a pair or threaded studs 182 to fit in the slots 116 of the casting 104. In the pocket decorating operation, decorative threads are to be sewn in the interior of the pocket. Thus, the presser arm 176 includes a central opening 184 where the sewing needle will pass to create the decorative stitching on the interior of the pocket blank. The computer controlling the sewing head 16 and x-y positioner 74 have to be adjusted to move the presser arm 176 in the desired path.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A sewing station comprising a table having, a generally planar section;

a loading guide having a recess for receiving a fabric blank therein;

means mounting the loading guide above the table section for movement between a loading position juxtaposed to the table and a removal position spaced from the table;

a sewing head having a reciprocable sewing needle defining a sewing location on the table;

means for sliding the fabric blank on the table section from the loading guide to the sewing location including a positioner having a movable member;

a presser arm in the shape of the recess and sized to fit the loading guide recess for pushing the fabric blank against the table section and sliding the fabric blank on the table section in response to movement of the movable member after the loading guide is moved to the removal position; and means mounting the presser arm on the movable member.

2. The sewing station of claim 1 wherein the means mounting the loading guide on the table comprises means removably mounting the loading guide on the table and the means mounting the presser arm on the movable member comprises means removably mounting the presser arm on the movable member.

3. The sewing station of claim 2 wherein the loading guide recess is the shape of a cuff/collar opening onto the table section in the loading position.

4. The sewing station of claim 1 wherein the table is substantially horizontal and further comprising means mounting the loading guide for movement from the loading position to a vertically spaced position above the loading position and means moving the presser arm in a horizontal direction away from the loading guide after moving the loading guide to the vertically spaced position.

5. The sewing station of claim 3 wherein the recess has the shape of a collar and further comprising a second loading guide having a second recess in the shape of a cuff for receiving a fabric blank therein, the second loading guide being attached to the guide mounting means after removal of the loading guide having the collar shaped recess and wherein the presser arm has the shape of a collar and further comprising a second presser arm in the shape of a cuff, the second presser arm being attached to the movable member after removal of the collar shaped presser arm.

6. The sewing station of claim 3 wherein the positioner comprises an x-y positioner for moving the movable member parallel to the table section and means on the movable member mounting the presser arm for vertical movement on the movable member.

7. The sewing station of claim 2 wherein the sliding means comprises means for sliding the fabric blank from the sewing location, after sewing, to a transfer location located on a side of the sewing head opposite from the loading guide and then moving the presser arm upwardly out of engagement with the fabric blank.

8. The sewing station of claim 7 further comprising an accumulator spaced from the transfer location and means for moving the fabric blank from the transfer location to the accumulator.

9. The sewing station of claim 8 further comprising a trap door and means moving the trap door between a closed position over the accumulator and an open position providing access to the accumulator, the blank moving means comprises a vacuum pickup bar and means for moving the vacuum pickup bar from the transfer location to a location above the trap door.

10. A sewing station comprising a table having a generally planar section;

a loading guide, above the table, having a recess for receiving a fabric blank therein;

means mounting the loading guide above the table section for movement between a loading position juxtaposed to the table and a removal position spaced from the table;

a sewing head having a reciprocable sewing needle defining a sewing location on the table;

means for sliding the fabric blank on the table section from the loading guide recess to the sewing location and then to a transfer location on a side of the sewing head opposite from the loading guide, the sliding means including a positioner having a presser arm in the shape of the recess and sized to fit in the loading guide recess for pushing the fabric blanks against the table section and sliding the fabric blanks on the table section in response to movement of the positioner after the loading guide is moved to the removal position;

a transfer mechanism, separate from the sliding means, for moving fabric blanks from the transfer location to a third location away from the sewing and transfer locations; and means operating the transfer mechanism while the sliding means moves between the transfer location and the loading guide.

11. The sewing station of claim 10 wherein the transfer mechanism operating means includes means operating the transfer mechanism while the sliding means moves between the transfer location and the loading guide.

12. The sewing station of claim 11 wherein the transfer mechanism operating means includes means operating the transfer mechanism while the sliding means moves from the transfer location toward the loading guide.

13. The sewing station of claim 10 wherein the transfer location is adjacent the sewing head and the third location is remote from the sewing head.

14. The sewing station of claim 13 further comprising means at the third location for accumulating the fabric blanks.

15. The sewing station of claim 14 wherein the transfer mechanism comprises a vacuum pickup, means for moving the vacuum pickup between the transfer and third locations and means for applying a vacuum to the vacuum pickup at the transfer location and for releasing the vacuum at the third location.

* * * * *